US008485627B2

(12) United States Patent
Takeishi

(10) Patent No.: US 8,485,627 B2
(45) Date of Patent: Jul. 16, 2013

(54) INKJET RECORDING APPARATUS AND LANDING-LOCATION ADJUSTMENT METHOD

(75) Inventor: Takahide Takeishi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 12/942,807

(22) Filed: Nov. 9, 2010

(65) Prior Publication Data

US 2011/0141183 A1 Jun. 16, 2011

(30) Foreign Application Priority Data

Dec. 11, 2009 (JP) ..... 2009-282291

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

2007/0008369 A1* 1/2007 Suzuki ..... 347/19

FOREIGN PATENT DOCUMENTS

| | | | |
|---|---|---|---|
| JP | 10-006533 | A | 1/1998 |
| JP | 2001-310456 | A | 11/2001 |
| JP | 2002-337431 | A | 11/2002 |
| JP | 2007-018375 | A | 1/2007 |

* cited by examiner

*Primary Examiner* — Laura Martin
(74) *Attorney, Agent, or Firm* — Canon USA, Inc., IP Division

(57) ABSTRACT

The present invention provides an inkjet recording apparatus recording image data by using recording heads that can be separately attached to and/or detached from the inkjet recording apparatus, wherein the attachment and/or detachment of each of the recording heads is detected, and only a pattern used to adjust the displacement of the landing location of the attached and/or detached recording head alone and a pattern used to adjust the displacement between the landing locations of recording heads including the attached and/or detached recording head are recorded.

5 Claims, 8 Drawing Sheets

FIG. 8

| ATTACHED AND/OR DETACHED INK CARTRIDGE | ADJUSTMENT ITEM | | |
|---|---|---|---|
| | TWO-WAY RECORDING | ODD NUMBERED COLUMN-EVEN NUMBERED COLUMN | BETWEEN DIFFERENT COLOR ARRAYS |
| CYAN | CYAN | CYAN | CYAN-MAGENTA |
| MAGENTA | MAGENTA | MAGENTA | CYAN-MAGENTA, MAGENTA-YELLOW |
| YELLOW | YELLOW | YELLOW | MAGENTA-YELLOW |
| CYAN, MAGENTA | CYAN, MAGENTA | CYAN, MAGENTA | CYAN-MAGENTA |
| CYAN, YELLOW | CYAN, YELLOW | CYAN, YELLOW | CYAN-MAGENTA, MAGENTA-YELLOW |
| MAGENTA, YELLOW | MAGENTA, YELLOW | MAGENTA, YELLOW | MAGENTA-YELLOW |
| CYAN, MAGENTA, YELLOW | CYAN, MAGENTA, YELLOW | CYAN, MAGENTA, YELLOW | CYAN-MAGENTA, MAGENTA-YELLOW |

INKJET RECORDING APPARATUS AND LANDING-LOCATION ADJUSTMENT METHOD

BACKGROUND OF THE INVENTION

1. Field of the Invention

The present invention relates to an inkjet recording apparatus provided to record data by discharging ink from a recording head and an ink-landing location-adjustment method used for the inkjet recording apparatus.

2. Description of the Related Art

The technology of adjusting the displacement of a dot-recording location (the landing location of an ink droplet) defined on a recording medium in an inkjet recording apparatus has been available. According to the technology disclosed in Japanese Patent Laid-Open No. 2007-18375, in an inkjet recording apparatus including at least one ink cartridge combined into a recording head, items that are subjected to the landing-location adjustment are determined in accordance with the type of an ink cartridge attached to the inkjet recording apparatus when the ink cartridge is attached to and/or detached from the inkjet recording apparatus. For example, when only an ink cartridge provided for a colored ink (hereinafter referred to as the color cartridge) is attached to the inkjet recording apparatus, a location adjustment (e.g., a location adjustment performed for the two-way recording) is performed for the color cartridge. Further, when the color cartridge and an ink cartridge provided for black ink (hereinafter referred to as the black cartridge) are attached to the inkjet recording apparatus, the location adjustment is performed between a recording head discharging the colored ink and that discharging the black ink, and the location adjustment is performed for each of the cartridges.

According to the technology disclosed in Japanese Patent Laid-Open No. 2007-18375, the items that are subjected to the location adjustment are determined based on the type of the attached ink cartridge (recording head). Therefore, the location adjustment is performed for an item that may not be adjusted when the ink cartridge is attached to and/or detached from the inkjet recording apparatus. For example, when a color cartridge is attached to and/or detached from the inkjet recording apparatus in the state where the color cartridge and the black cartridge are attached to the inkjet recording apparatus, the location adjustment is performed between a recording head discharging colored ink and that discharging black ink, and a discharge-location adjustment is performed for each of the cartridges. However, since the black cartridge is not attached to and/or detached from the inkjet recording apparatus, the location adjustment (the location adjustment performed for the two-way recording, etc.) may not be performed for the recording head discharging the black ink.

Thus, determining items subjected to the landing-location adjustment based on the type of an attached ink cartridge (recording head) may lead to the execution of the location adjustment for an item that may not be adjusted.

SUMMARY OF THE INVENTION

According to an embodiment of the present invention, an inkjet recording apparatus that records an image by discharging ink from a plurality of recording heads that can be separately attached to and/or detached from the inkjet recording apparatus, wherein the inkjet recording apparatus includes a detecting unit configured to detect attachment and/or detachment of each of the recording heads, and a pattern recording unit configured to record a pattern used to adjust a displacement of a landing location of each of the recording heads and a pattern used to adjust a displacement between landing locations of two recording heads of the recording heads, and wherein the pattern recording unit only generates a pattern used to adjust a displacement of a landing location of an attached and/or detached recording head alone and a pattern used to adjust a displacement between landing locations of recording heads including the attached and/or detached recording head.

According to another embodiment of the present invention, a method of adjusting a landing location of ink, the method being used for an inkjet recording apparatus that records a image by discharging ink from a plurality of recording heads that can be separately attached to and/or detached from the inkjet recording apparatus, wherein the ink-landing location-adjustment method includes the steps of detecting attachment and/or detachment of each of the recording heads, and recording a pattern used to adjust a displacement of a landing location of each of the recording heads and a pattern used to adjust a displacement between landing locations of two recording heads of the recording heads, and wherein, during the pattern recording, only a pattern used to adjust a displacement of a landing location of an attached and/or detached recording head alone and a pattern used to adjust a displacement between landing locations of recording heads including the attached and/or detached recording head are recorded.

The present invention has been achieved not to execute the location adjustment for an item that may not be adjusted at the time of attachment and/or detachment of an ink cartridge.

Further features of the present invention will become apparent from the following description of exemplary embodiments with reference to the attached drawings.

BRIEF DESCRIPTION OF THE DRAWINGS

FIG. 8 is a diagram illustrating the data of an adjustment-item determining table.

DESCRIPTION OF THE EMBODIMENTS

Control Configuration of Inkjet Recording Apparatus

Figure 1:
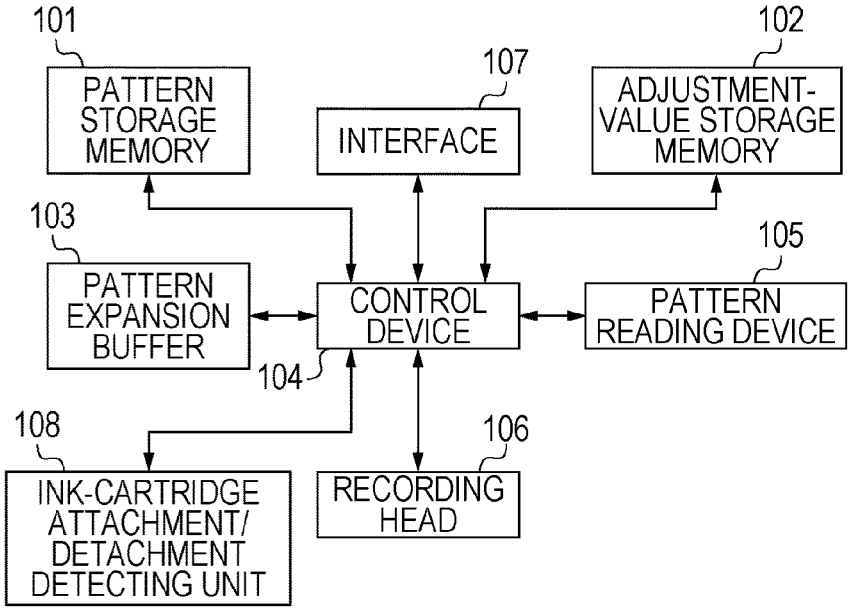
FIG. 1 is an exemplary control configuration diagram of an inkjet recording apparatus according to an embodiment of the present invention.

FIG. 1 is a block diagram illustrating the control configuration of an inkjet recording apparatus according to an embodiment of the present invention. A pattern storage memory 101 is provided to store data of a reference pattern and adjustment patterns that are provided to adjust the landing location of ink discharged from a recording head. The pattern storage memory 101 is provided in an inkjet recording apparatus 100 (hereinafter referred to as the recording apparatus) and includes an involatile memory provided as a read-only memory (ROM). Here, the pattern storage memory 101 may be provided not in the main body of the recording apparatus, but in an external apparatus such as a computer. In that case, the transfer of the adjustment pattern data stored in the pattern storage memory 101 may be achieved via an interface 107.

An adjustment-value storage memory 102 is provided to store data of a result of the landing-location adjustment. The adjustment-value storage memory 102 is provided in the main body of the recording apparatus and includes a rewritable involatile memory provided as an electrically erasable programmable read-only memory (EEPROM). The adjustment-value storage memory 102 may be provided in an external apparatus as is the case with the pattern storage memory 101. When an ordinary user stores data of a desired image, the data storage is performed based on adjustment-value data stored in the above-described adjustment-value storage memory 102.

A pattern expansion buffer 103 is a volatile memory including a random-access memory (RAM) provided in the main body of the recording apparatus. The pattern expansion buffer 103 is configured to temporarily store and retain the pattern data stored in the pattern storage memory 101 for storage. A control device 104 is provided in the main body of the recording apparatus to control calculation processing, the cooperation between devices, and the entire recording apparatus. The control device 104 corresponds to a central processing unit (CPU) and/or a microprocessing unit (MPU).

A pattern reading device 105 is the sensor of an optical system provided in the recording apparatus, the optical system including a light-emitting member and a light-receiving member. The pattern reading device 105 is used to convert data of the density of pattern data recorded onto a recording medium into an electric signal and read the electric signal. A recording head 106 is a device provided to discharge ink onto a recording medium, where the device is often used in an inkjet system. The recording head 106 is provided to record pattern data that is transmitted from the pattern storage memory 101 and that is expanded through the pattern expansion buffer 103 based on data of an instruction issued from the control device 104. Further, when the pattern data expanded through the pattern expansion buffer 103 is stored in the recording head 106, the control device 104 can change the ink-discharge time based on the adjustment-value data stored in the adjustment-value storage memory 102 to adjust the landing location of an ink droplet.

The interface 107 is a device provided to receive and/or transmit stored data and data of a control command that are transmitted from an external device and/or apparatus including a computer, a digital camera, etc.

An ink-cartridge attachment/detachment detecting unit 108 is provided to detect the attachment/detachment state of an ink cartridge including a combination of a recording head and an ink tank, and is capable of detecting the attachment and/or detachment of the ink cartridge based on the electrical connection between the ink cartridge and a carriage. At that time, the ink-cartridge attachment/detachment detecting unit 108 detects the attached and/or detached ink cartridge. Though not illustrated in FIG. 1, the inkjet recording apparatus of the above-described embodiment includes a power supply provided to drive a carriage including a recording-medium feeding mechanism, a paper feeding mechanism, a paper ejecting mechanism, at least one ink tank, and the recording head 106.

[Configuration of Inkjet Recording Apparatus]

Figure 2:
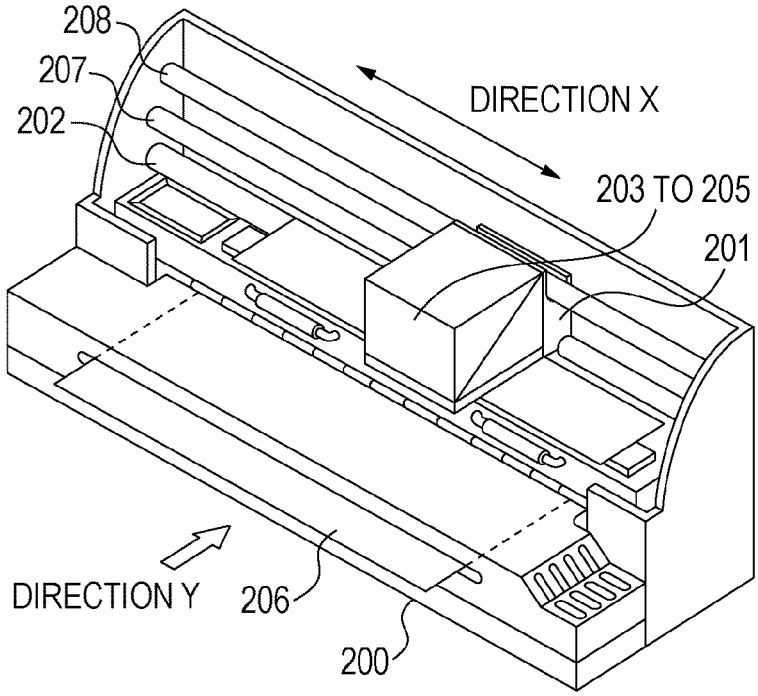
FIG. 2 is an exemplary external perspective view of an inkjet recording apparatus according to another embodiment of the present invention.

FIG. 2 is an exemplary external perspective view of an inkjet recording apparatus according to another embodiment of the present invention. A recording medium 206 inserted into a paper-feeding position defined on the recording apparatus 100 is conveyed to the recordable area of each of ink cartridges 203, 204, and 205 through a feeding roller 202. A carriage 201, which can move in a direction X defined based on two guide axes 207 and 208, reciprocally scans the recordable area. Each of ink cartridges 203, 204, and 205 is provided on the carriage 201, where the cartridges include individual combinations of ink tanks that are provided to supply ink of individual colors including cyan, magenta, and yellow, and recording heads discharging the individual inks.

Figure 3A:
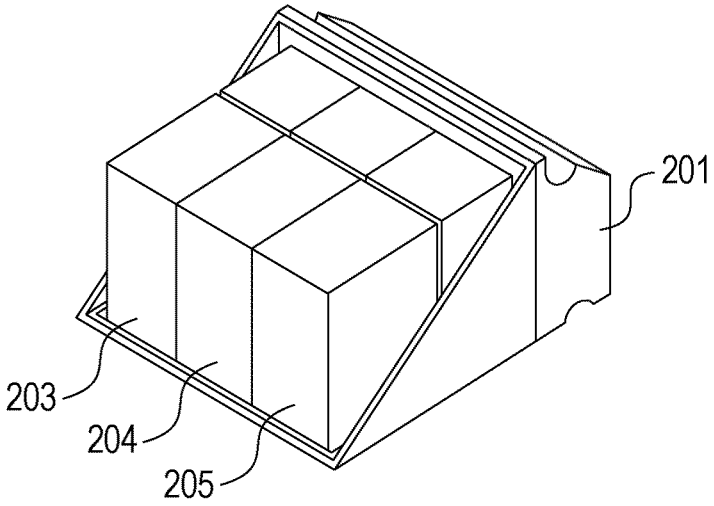
FIG. 3A is an exemplary configuration diagram of ink cartridges.
Figure 3B:
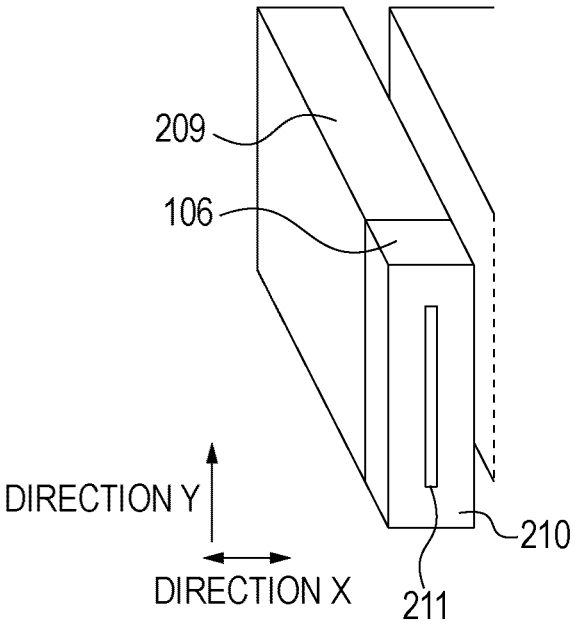
FIG. 3B is an exemplary configuration diagram of each of the ink cartridges.

FIGS. 3A and 3B illustrate exemplary configurations of the ink cartridges. As illustrated in FIG. 3A, each of the ink cartridge 203 used for the cyan ink, the ink cartridge 204 used for the magenta ink, and the ink cartridge 205 used for the yellow ink can be independently attached and/or detached to and/or from the carriage 201. FIG. 3B illustrates an exemplary configuration of an ink cartridge, which is the same as the configuration of each of the ink cartridges 203 to 205 that are provided for the individual colors. The ink cartridge includes an ink tank 209 containing the ink and the recording head 106 discharging the ink. A nozzle array (discharge port array) 211 is provided on a discharge-port face 210 of the recording head 106, where nozzles (discharge ports) that are used to discharge the ink in a direction Y perpendicular to a scan direction X are arrayed on the discharge-port face 210. Further, the nozzle array (discharge-port array) 211 is divided into an odd-numbered array and an even-numbered array, and the two arrays are displaced with respect to each other in the direction Y by as much as half the nozzle pitch.

Next, the steps of adjusting the displacement of a landing location, which are performed in the above-described embodiment, will be described with reference to FIG. 4. First, at step S401, data of patterns that are provided to adjust the landing-location displacement is recorded onto a recording medium. Then, at step S402, the optical density of each of the patterns is measured through the pattern reading device 105. Data of the optical density of each of the patterns, the optical density being measured at step S402, is temporarily stored and used to perform the step of calculating (acquiring) adjustment values at step S403.

It is determined whether or not acquisition of the adjustment value of each of adjustment items is finished at step S404. In the above-described embodiment, adjustment items for which the location adjustment is performed vary based on the combination of additionally attached ink cartridges. The variation will be described later in detail.

If it is determined that the adjustment-value acquisition is finished for each of the adjustment items at step S404, data of the adjustment value of each of the adjustment values is stored in the adjustment-value storage memory 102 at step S405. When recording data after the above-described adjustment-value storage, the discharge time is changed based on the adjustment values. Further, if it is determined that the adjustment-value acquisition is not finished for each of the adjustment items at step S404, the processing returns to step S401 so that the adjustment value is acquired for each of the adjustment items for which the adjustment-value acquisition is not finished through the pattern-data storage and the optical-density reading.

Figure 5A:
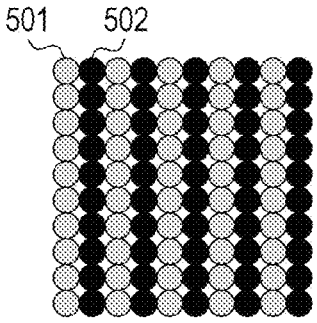
FIG. 5A is a diagram illustrating pattern data stored during the landing-location adjustment.
Figure 5B:
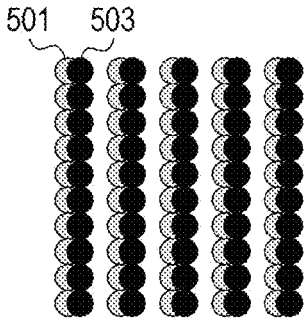
FIG. 5B is a diagram illustrating different pattern data stored during the landing-location adjustment.
Figure 5C:
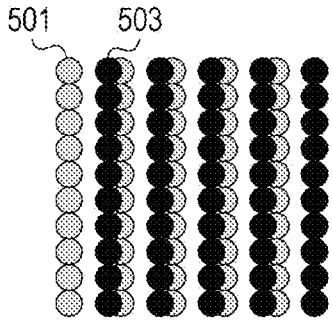
FIG. 5C is a diagram illustrating different pattern data stored during the landing-location adjustment.

Each of FIGS. 5A, 5B, and 5C is provided to illustrate the above-described pattern data recorded onto the recording medium at step S401.

Hereinafter, an exemplary adjustment of a landing location observed when data recording is performed in the going direction and that observed when the data recording is performed in the returning direction, which is performed for a given nozzle array during the two-way recording, will be described. In the above-described embodiment, data of a single reference pattern and at least two adjustment patterns is stored, an adjustment pattern having the closest optical reflection density to that of the reference pattern is detected, and data of the time of ink discharge performed at the time of storing the above-described adjustment pattern is acquired, as an adjustment value. The above-described adjustment will be described later in detail.

First, FIG. 5A is a diagram schematically illustrating the dot arrangement of the reference pattern. In the reference pattern indicated by the sign "R", data of both reference dots 501 and 502 is recorded in the same scan direction (the going direction and/or the returning direction). That is to say, the reference pattern is recorded as a pattern having an ideal dot arrangement without being affected by the displacement between the landing location of the going-direction recording and that of the returning-direction recording. Here, the ideal dot arrangement denotes a dot arrangement where the reference dots 501 and 502 do not overlap one another. However, the ideal dot arrangement may be a dot arrangement where the reference dots 501 and 502 entirely overlap one another.

FIGS. 5B and 5C are diagrams schematically illustrating the dot arrangements of the adjustment patterns. According to the adjustment pattern illustrated in FIG. 5B, adjustment dots 503 of which data is recorded in the returning direction (the left direction, the direction −X) are displaced from the reference dots 501 of which data is recorded in the going direction (the right direction, the direction +X) by as much as +1. Namely, the adjustment pattern illustrated in FIG. 5B has a displacement amount of +1. Here, the displacement amount will be described. When the landing location of the adjustment dot is displaced from the reference dot in the scan traveling direction of the recording head, the sign "+" is used to express the displacement amount, and when the landing location of the adjustment dot is displaced from the reference dot in the direction opposite to the scan traveling direction, the sign "−" is used to express the displacement amount. Further, the recording apparatus of the above-described embodiment allows for displacing the landing location of the adjustment dot in units of 4800 dpi. Therefore, the sizes of displacement amounts that are expressed as "1" and "2" are determined to be $1/4800$ inch and $2/4800$ inch. Namely, the displacement amount expressed by using the sign "+1" denotes that the adjustment dot 503 is displaced from the reference dot 501 in the traveling direction of the returning direction (the −X direction) by as much as $1/4800$ inch. According to the adjustment pattern illustrated in FIG. 5C, the adjustment dot 503 of which data is recorded in the returning direction is displaced from the reference dot 501 of which data is recorded in the going direction by as much as −1. Namely, the adjustment pattern illustrated in FIG. 5C has a displacement amount of −1.

If there is no displacement between the landing location corresponding to the going-direction recording and that corresponding to the returning-direction recording, data of both the pattern having the displacement amount of +1 and the pattern having a displacement amount of −1 is recorded with a displacement from the ideal dot arrangement as illustrated in FIGS. 5B and 5C. If the adjustment pattern having the displacement amount of +1 attains the ideal dot arrangement equivalent to that of the reference pattern, the landing location corresponding to the returning-direction recording is relatively displaced from that corresponding to the going-direction recording by as much as −1. Consequently, a displacement amount of −1 is detected. In the above-described embodiment, therefore, data of a plurality of adjustment patterns having different displacement amounts of from +5 to −5 is recorded, and data of an adjustment pattern similar to the dot arrangement of the reference pattern is detected. Then, the detected adjustment pattern data is recorded and the displacement amount corresponding to the recorded adjustment pattern data is acquired as an adjustment value so that the landing location is adjusted based on the adjustment value at the actual recording time.

Next, the optical density of each of patterns of which data is recorded through the pattern reading device 105 is measured at step S402, so as to detect the adjustment pattern similar to the dot arrangement of the reference pattern. The optical reflection density of the pattern is relative to the state of the dots overlapping one another. Therefore, it becomes possible to detect the adjustment pattern similar to the dot arrangement of the reference pattern by selecting an adjustment pattern having the closest optical reflection density to that of the reference pattern. For measuring the density of each of the patterns, the method of measuring and acquiring the average density obtained in a relatively large area as the density of each of the patterns may be used.

In the above-described embodiment, the displacement between the landing locations corresponding to the individual going-direction recording and returning-direction recording that are performed during the two-way recording is exemplarily adjusted. However, the above-described embodiment can be used for adjusting a displacement between the landing locations corresponding to nozzle arrays that are provided for different colors, where the displacement occurs in the scan direction. Further, the above-described embodiment can also be used for adjusting a displacement between the landing locations corresponding to an odd-numbered array and an even-numbered array that are provided for the same color. For example, for adjusting a displacement between the landing locations corresponding to a cyan nozzle array and a magenta nozzle array, data of the reference dots 501 and 502 of the reference pattern is recorded through the cyan nozzle array, data of the reference dots of the adjustment pattern is recorded through the cyan nozzle array, and data of the adjustment dots of the adjustment pattern is recorded through the magenta nozzle array. For adjusting the displacement between the landing locations corresponding to the odd-numbered array and the even-numbered array that are provided for the same color, data of the reference dots 501 and 502 of the reference pattern is recorded through the odd-numbered array, data of the reference dots of the adjustment pattern is recorded through the odd-numbered array, and data of the adjustment dots of the adjustment pattern is recorded through the even-numbered array.

Figure 6:
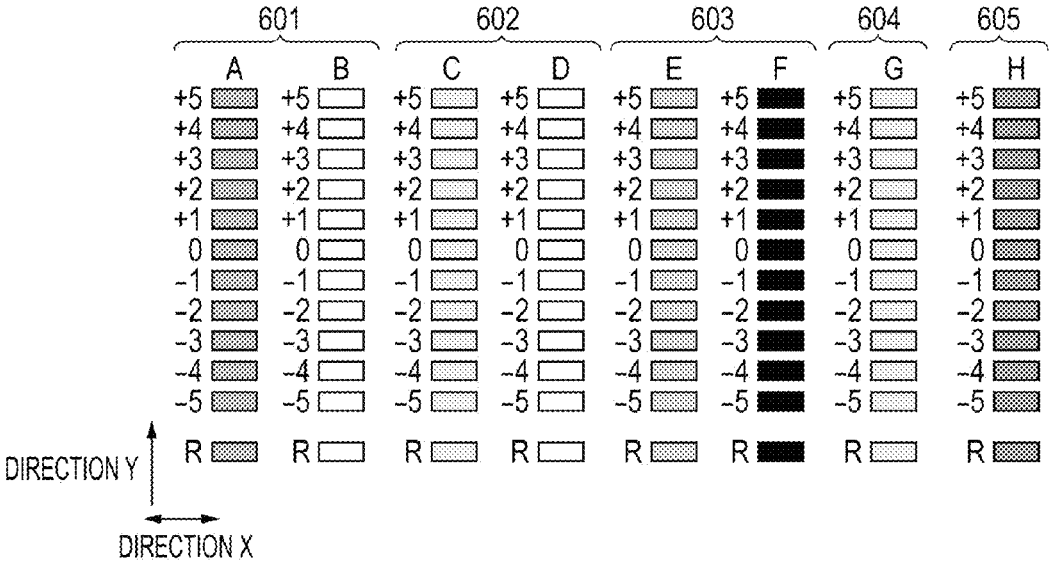
FIG. 6 is a diagram illustrating an ordinary layout of the pattern data stored during the landing-location adjustment.

FIG. 6 illustrates an ordinary layout of a pattern recorded onto the recording medium 206. A pattern 601 is a pattern of the landing-location adjustment relating to the cyan cartridge 203. A column A is a pattern of the landing-location adjustment performed when the two-way recording is executed through the cyan-nozzle array, and a column B is a pattern of the landing-location adjustment performed for the odd-numbered array and the even-numbered array of the cyan nozzle array. A pattern 602 is a pattern of the landing-location adjustment relating to the magenta cartridge 204. A column C is a pattern of the landing-location adjustment performed when the two-way recording is executed through the magenta-nozzle array, and a column D is a pattern of the landing-location adjustment performed for the odd-numbered array and the even-numbered array of the magenta nozzle array. A pattern 603 is a pattern of the landing-location adjustment relating to the yellow cartridge 205. A column E is a pattern of the landing-location adjustment performed when the two-way recording is executed through the yellow-nozzle array, and a column F is a pattern of the landing-location adjustment performed for the odd-numbered array and the even-numbered array of the yellow nozzle array.

A pattern 604 is a pattern of the landing-location adjustment performed between the cyan cartridge 203 and the magenta cartridge 204, and a column G is a pattern of the landing-location adjustment performed for the cyan nozzle array and the magenta nozzle array in the scan direction. A pattern 605 is a pattern of the landing-location adjustment performed between the magenta cartridge 204 and the yellow cartridge 205, and a column H is a pattern of the landing-location adjustment performed for the magenta nozzle array and the yellow nozzle array in the scan direction.

In the above-described embodiment, the landing-location adjustment performed between the nozzle arrays that are performed for different colors (between recording heads) is determined to be the relative location-adjustment management. Namely, in the above-described embodiment, only the values of location adjustments that are performed between the adjacent nozzle arrays are acquired. As for the location adjustments that are performed between other nozzle arrays, the landing location is adjusted based on a combination of the location-adjustment values. More specifically, the value of a location adjustment performed between the cyan nozzle array and the magenta nozzle array (the column G) and that of a location adjustment performed between the magenta nozzle array and the yellow nozzle array (the column H) are acquired, as the value of a location adjustment performed between the adjacent nozzle arrays. Then, the location adjustment between the cyan nozzle array and the yellow nozzle array is performed by adding two adjustment values to each other. The above-described relative management allows for reducing adjustment values that are used for performing the location adjustment among many nozzle arrays, which leads to a reduction in the storage capacity of the memory 102.

Figure 7:
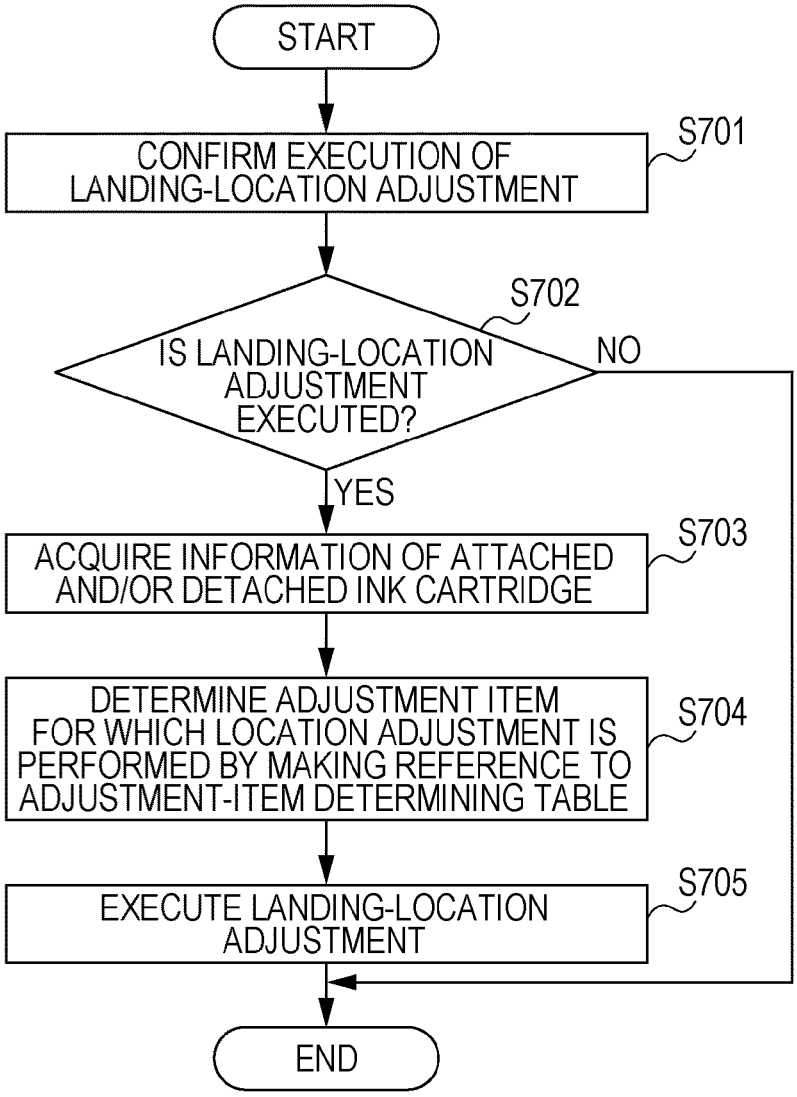
FIG. 7 is a diagram illustrating the flow of processing performed at the time of attachment and/or detachment of the ink cartridge.

FIG. 7 illustrates the flow of processing performed at the time of the attachment and/or detachment of the ink cartridge. The above-described processing flow is triggered by, for example, the attachment and/or detachment of the ink cartridge, which is detected through the ink-cartridge attachment/detachment detecting unit 108. When the attachment and/or detachment of the ink cartridge is detected through the ink-cartridge attachment/detachment detecting unit 108, it is confirmed whether or not a user wishes to execute the landing-location adjustment at step S701. The method of confirmation includes, for example, the method of displaying a message inquiring whether or not the landing-location adjustment should be performed on the monitor of a host personal computer (PC) connected to the recording apparatus and issuing an instruction to and/or not to execute the landing-location adjustment through the user operating the mouse and the keyboard of the PC. Further, it may be configured that the landing-location adjustment is automatically executed when the ink cartridge is attached and/or detached to and/or from the inkjet recording apparatus.

When it is confirmed that the instruction to execute the landing-location adjustment is issued at step S702, the processing advances to step S703 so that information about the attached and/or detached ink cartridge is acquired. Next, at step S704, an adjustment item for which the location adjustment is executed is determined based on the information about the attached and/or detached ink cartridge by making a reference to an adjustment-item determining table.

FIG. 8 shows the adjustment-item determining table used at step S704. Data of the above-described table is stored in an involatile memory (ROM) provided in the main body of the recording apparatus and is read through the control device 104. The table data may be stored in the same memory as that of the storage memory 101 and/or the adjustment-value storage memory 102. The above-described embodiment allows for recording data of only the pattern of an adjustment item relating to the attached and/or detached ink cartridge and acquiring the landing-location adjustment value corresponding to the adjustment-item pattern, as illustrated in FIG. 8.

For example, when the cyan cartridge alone is attached and/or detached from the recording apparatus, adjustment items relating to the cyan nozzle array are selected. Namely, an adjustment for the two-way recording performed through the cyan nozzle array, an adjustment between the odd-numbered array and the even-numbered array of the cyan nozzle array, and an adjustment between the cyan nozzle array and the magenta nozzle array are performed. Further, since no attachment and/or detachment operation is performed for the magenta cartridge and the yellow cartridge, the displacement between the landing locations of the magenta cartridge and the yellow cartridge is not changed. Therefore, no adjustment is performed for the magenta cartridge and the yellow cartridge.

Figure 4:
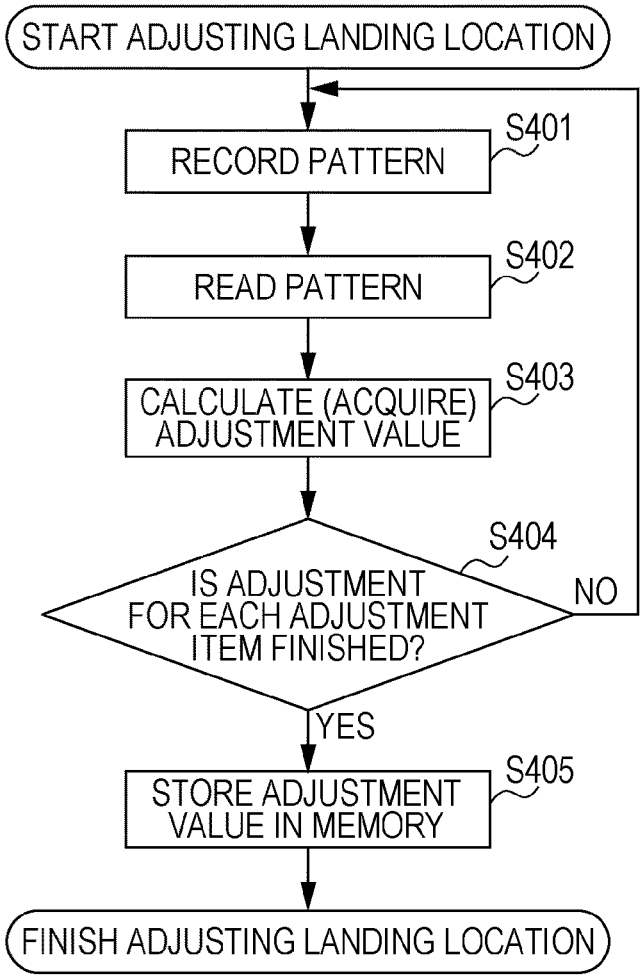
FIG. 4 is a diagram illustrating the steps of adjusting a landing location.

After the adjustment items are selected, the landing-location adjustment is subsequently performed at step S705 as illustrated in FIG. 4. According to the processing flow illustrated in FIG. 4, processing including the pattern recording, the pattern reading, etc. is performed until the adjustment is finished for each of the selected adjustment items, at step S404. As for the pattern recording, it may be arranged that the data of a pattern which may not be adjusted is not recorded, or the space of an unuseful pattern is omitted for recording while maintaining the layout illustrated in FIG. 7.

Thus, according to the above-described embodiment, it may be arranged that the location adjustment is not performed for an ink cartridge that may not be adjusted and/or an ink cartridge that is not attached and/or detached, and that may not be adjusted.

Other Embodiments

In the above-described embodiment, the attachment and/or detachment of an ink cartridge is detected. Therefore, it has been difficult to detect whether an additionally attached ink cartridge is another ink cartridge or an ink cartridge that is reattached after having been detached once (a cartridge that was previously attached). Therefore, according to another embodiment of the present invention, it is arranged to discriminate between "change" denoting the attachment of another ink cartridge and "reattachment" denoting an ink cartridge reattached as it is after having been detached once. In that case, the processing is changed based on whether the "change" or the "reattachment" is performed.

Each of ink cartridges that are used for the above-described embodiment includes a memory storing individual information, where the memory is provided in the recording head. When the ink-cartridge is attached and/or detached, the ink-cartridge attachment/detachment detecting unit 108 can detect whether the ink cartridge (recording head) is "changed" or "reattached" by reading the individual information from the memory. Namely, if the individual information obtained before the attachment and/or detachment is performed is different from that obtained after the attachment and/or detachment is performed, it is determined that the "change" is performed. Otherwise, it is determined that the "reattachment" is performed. When the "change" is detected, the adjustment items are determined as is the case with the above-described embodiment.

On the contrary, when the "reattachment" is detected, the location adjustment (the two directions, between the odd-numbered array and the even-numbered array) is not performed through a single ink cartridge (a single recording head). Since there is no change in the discharge property of the "reattached" ink cartridge (recording head), the location adjustment performed through the single "reattached" ink cartridge may be omitted.

For example, when the cyan cartridge alone is "reattached", the adjustment for the two-way recording performed through the cyan nozzle array and the adjustment between the odd-numbered array and the even-numbered array of the cyan nozzle array are not performed, but only the adjustment between the cyan nozzle array and the magenta nozzle array is performed.

Thus, the above-described embodiment allows for discriminating between the "change" and the "reattachment" of an ink cartridge so that the location adjustment performed through a single ink cartridge is not executed when the ink cartridge is "reattached".

[Others]

In the above-described embodiments, the inkjet recording apparatus provided for the three color inks including the cyan ink, the magenta ink, and the yellow ink has been exemplarily described. However, the inkjet recording apparatus may be provided for additional color inks including a black ink, a light-colored ink, and a special-colored ink including a red ink, a green ink, and so forth.

Further, in the above-described embodiments, the adjustment values are obtained by storing data of the single reference pattern and the plurality of adjustment patterns and detecting data of an adjustment pattern having the closest optical reflection density to that of the reference pattern. However, as has been widely perceived, the method of storing data of a plurality of patterns having different displacement amounts and determining the displacement amount corresponding to the maximum optical reflection density and/or the displacement amount corresponding to the minimum optical reflection density to be the adjustment value may be used. Namely, the adjustment value may be acquired from any kinds of patterns.

Further, when a significant impact is given to the recording apparatus when an ink cartridge is attached and/or detached thereto and/or therefrom and when a predetermined time has elapsed since the execution of the previous location-adjustment processing, for example, the location adjustment may be performed for an ink cartridge which is not attached and/or detached to and/or from the recording apparatus.

Further, in the above-described embodiments, each of the adjustment performed for the two-way recording and that performed between the odd-numbered array and the even-numbered array has been exemplarily described as the location adjustment relating to a single ink cartridge. However, the adjustment of the inclination of a nozzle array may be additionally performed, for example. Further, the landing-location adjustment performed in, for example, the sub-scan (conveyance) direction may be performed in addition to the landing-location adjustment performed in the scan direction as the location adjustment performed between ink cartridges that are provided for different colors. Further, even though the landing-location adjustment is performed for each of the three adjustment items in the above-described embodiments, the number of types of the adjustment items may be reduced.

Further, in the above-described embodiments, the inkjet recording apparatus including the ink cartridge provided with the combination of the recording heads and the ink tanks has been exemplarily described. However, so long as each of the recording heads can be attached and/or detached to and/or from the inkjet recording apparatus, the adjustment items may be determined in accordance with the attached and/or detached recording head as is the case with the above-described embodiments even though the recording heads and the ink tanks are separately provided. Further, if the inkjet recording apparatus has the recording heads and the ink tanks that are separately provided, the adjustment items may be determined based on the attachment and/or detachment of the ink tank. This is because an impact given to the inkjet recording apparatus when the ink tank is attached and/or detached thereto and/or therefrom may displace the landing location corresponding to a recording head combined into the attached and/or detached ink tank.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-282291 filed Dec. 11, 2009, which is hereby incorporated by reference herein in its entirety.

What is claimed is:

1. An inkjet recording apparatus that records an image by discharging ink from a plurality of recording heads that can be separately attached to and/or detached from the inkjet recording apparatus, the inkjet recording apparatus comprising:

a detecting unit configured to detect attachment and/or detachment of each of the recording heads; and a pattern recording unit configured to record a pattern used to adjust a displacement of a landing location of each of the recording heads and a pattern used to adjust a displacement between landing locations of two recording heads of the plurality of recording heads, wherein the pattern recording unit only records a pattern used to adjust a displacement of a landing location of an attached and/or detached recording head alone and a pattern used to adjust a displacement between landing locations of recording heads including the attached and/or detached recording head, wherein each of the recording heads includes a memory storing individual information, wherein the detecting unit detects whether an attached recording head was previously attached based on the individual information of the recording heads, the individual information being obtained after a recording head is attached, and wherein when the detecting unit detects that the attached recording head was previously attached, the pattern recording unit only records a pattern used to adjust a displacement between landing locations of recording heads including the reattached recording head.

2. The inkjet recording apparatus according to claim 1, further comprising an adjusting unit configured to adjust the displacement of the landing location of each of the recording heads and the displacement between the landing locations of the two recording heads based on the recorded pattern, wherein the adjusting unit adjusts the displacement between the landing locations of the two recording heads based on a combination of adjusting values that are used to adjust a displacement between landing locations of adjacent recording heads.

3. The inkjet recording apparatus according to claim 1, wherein the displacement of the landing location of each of the recording heads is a displacement of a landing location of ink discharged from the recording head in a going direction and a returning direction that are included in a scan direction, and wherein the displacement between the landing locations of the two recording heads is a displacement between landing locations of the two recording heads, the displacement occurring in the scan direction.

4. The inkjet recording apparatus according to claim 1, wherein the recording head is integrated into an ink tank provided to contain the ink.

5. A method of adjusting a landing location of ink, the method being used for an inkjet recording apparatus that records a image by discharging ink from a plurality of recording heads that can be separately attached to and/or detached from the inkjet recording apparatus, the ink-landing location-adjustment method comprising the steps of:

detecting attachment and/or detachment of each of the recording heads; and recording a pattern used to adjust a displacement of a landing location of each of the recording heads and a pattern used to adjust a displacement between landing locations of two recording heads of the plurality of recording heads, wherein, during the pattern recording, only a pattern used to adjust a displacement of a landing location of an attached and/or detached recording head alone and a pattern used to adjust a displacement between landing locations of recording heads including the attached and/or detached recording head are recorded, wherein each of the recording heads includes a memory storing individual information, wherein the detecting step detects whether an attached recording head was previously attached based on the individual information of the recording heads, the individual information being obtained after a recording head is attached, and wherein when the detecting step detects that the attached recording head was previously attached, the recording step only records a pattern used to adjust a displacement between landing locations of recording heads including the reattached recording head.

* * * * *